United States Patent [19]

Kuroda et al.

[11] 4,198,942

[45] Apr. 22, 1980

[54] DUAL SPARK PLUG IGNITION ENGINE WITH EGR SYSTEM

[75] Inventors: Hiroshi Kuroda, Tokyo; Yasuo Nakajima, Yokosuka; Yoshimasa Hayashi, Yokohama, all of Japan

[73] Assignee: Nissan Motor Company, Limited, Yokohama, Japan

[21] Appl. No.: 860,901

[22] Filed: Dec. 15, 1977

[30] Foreign Application Priority Data

Dec. 17, 1976 [JP] Japan ..... 51-150733

[51] Int. Cl.[2] ..... F02P 1/00

[52] U.S. Cl. ..... 123/148 DS; 123/148 C; 123/148 CE; 123/119 A

[58] Field of Search ..... 123/148 C, 148 DS, 119 A; 361/250, 249, 261; 315/226

[56] References Cited

U.S. PATENT DOCUMENTS

| | | | |
|---|---|---|---|
| 1,901,846 | 3/1933 | Klaiber | 123/148 DS |
| 2,465,080 | 3/1949 | Fitzsimmons | 123/148 C |
| 3,554,092 | 1/1971 | Shibagaki | 123/148 C |
| 3,716,991 | 2/1973 | Tatsutomi et al. | 123/148 DS |
| 3,756,210 | 9/1973 | Kuehl | 123/119 A |
| 3,809,042 | 5/1974 | Hosho et al. | 123/148 C |
| 3,929,115 | 12/1975 | Yamauti et al. | 123/148 DS |
| 3,935,844 | 2/1976 | Nishimiya et al. | 123/148 DS |
| 3,964,454 | 6/1976 | Nishimiya | 123/148 DS |
| 4,054,114 | 10/1977 | Saita | 123/148 DS |
| 4,091,615 | 5/1978 | Hayashi et al. | 123/148 C |

*Primary Examiner*—Charles J. Myhre
*Assistant Examiner*—P. S. Lall
*Attorney, Agent, or Firm*—Schwartz, Jeffery, Schwaab, Mack, Blumenthal & Koch

[57] ABSTRACT

A dual spark plug ignition engine is equipped with an EGR system. The two spark plugs in each combustion chamber are simultaneously energized to produce sparks to ignite the charge in the combustion chamber under a normal engine operating conditions, whereas the spark plugs are energized with a predetermined phase difference from each other under high power output engine operating conditions.

9 Claims, 5 Drawing Figures

DUAL SPARK PLUG IGNITION ENGINE WITH EGR SYSTEM

BACKGROUND OF THE INVENTION

This invention relates, in general, to a dual spark ignition internal combustion engine in which two spark plugs are disposed in each combustion chamber to ignite the air-fuel mixture inducted thereto, and more particularly to an improvement in the ignition system of the above-mentioned engine.

In connection with the exhaust gas emission control of a spark-ignition internal combustion engine which discharges exhaust gases containing nitrogen oxides (NOx), it is difficult to decrease the emission level of NOx because the formation of NOx is increased as the combustion is improved, i.e. combustion temperature rises, and NOx once generated in the combustion chamber is not easily removed by a catalytic reduction reaction, the catalyst also producing problems with respect to performance and durability. Therefore, the greatest effort is now directed to suppression of the NOx generation in the combustion chamber. Since the NOx emission control downstream of the combustion chamber encounters the above-mentioned problems, it is necessary to achieve suppression of NOx generation within the combustion chamber. For this purpose, it has been proposed to supply exhaust gases into the combustion chamber in order to lower the maximum temperature of combustion carried out in the combustion chamber. This is achieved, for example, by a so-called exhaust gas recirculation system (EGR system) which is known as disclosed, for example, in U.S. Pat. No. 3,756,210, issued Sept. 4, 1973 to Kuehl. With this recirculation of the exhaust gases, the emission level of NOx is found to decrease as the amount of the exhaust gases is increased. However, by supplying the combustion chamber with a considerable proportion of the exhaust gases, the combustion time of the air-fuel mixture is increased and therefore stable and smooth combustion of the air-fuel mixture in the combustion chamber fails. In view of the above, the amount of the exhaust gases supplied to the combustion chamber is restricted to a relatively low level in due consideration of both stable combustion and NOx generation control. The unstable combustion of the air-fuel mixture causes deterioration of engine power output and fuel consumption characteristics.

In view of the above, attention has been directed to the idea that stable combustion in the combustion chamber is obtained by fast burn of the air-fuel mixture in the combustion chamber by shortening the combustion time of the air-fuel mixture. To this end, a dual spark plug ignition engine with two spark plugs in each combustion chamber has been proposed by the same applicant as the present application to maintain stable combustion in the combustion chamber even though a considerably large amount of exhaust gases is recirculated back to the combustion chamber.

However, this proposed dual spark plug ignition engine requires further improvement from the standpoint of decreasing engine noise and increasing engine durability, since the engine noise is increased and the engine durability is decreased by an excessively high pressure rise in the combustion chamber of the engine under a high power output engine operating condition. The excessively high pressure rise occurs under the high power output engine operating conditions because of the following reasons: (1) The exhaust gas recirculation is stopped or controlled to its minimum value to prevent degradation of engine power output and fuel consumption; (2) The air-fuel ratio of the mixture supplied to the combustion chamber is slightly enriched to obtain high power output; and (3) Since the throttle valve is widely opened, the charging efficiency of the inducted air-fuel mixture becomes considerably high.

SUMMARY OF THE INVENTION

It is the prime object of the present invention to provide an improved dual spark plug ignition engine with an EGR system, which engine can suppress the generation of severe engine noise and improve its durability.

Another object of the present invention is to provide an improved dual spark plug ignition engine with an EGR system, in which an excessively high pressure rise in the combustion chamber of the engine can be suppressed particularly under high power output engine operating conditions.

A further object of the present invention is to provide an improved dual spark plug ignition engine with an EGR system, in which the two spark plugs in each combustion chamber are simultaneously energized to produce sparks to ignite the charge in the combustion chamber under normal engine operating conditions, while the two spark plugs are energized with a predetermined phase difference or time difference from each other under high power output engine operating conditions.

Other objects, features and advantages of the engine according to the present invention will be more apparent from the following description taken in conjunction with the accompanying drawings.

DESCRIPTION OF THE PREFERRED EMBODIMENTS

Figure 1:
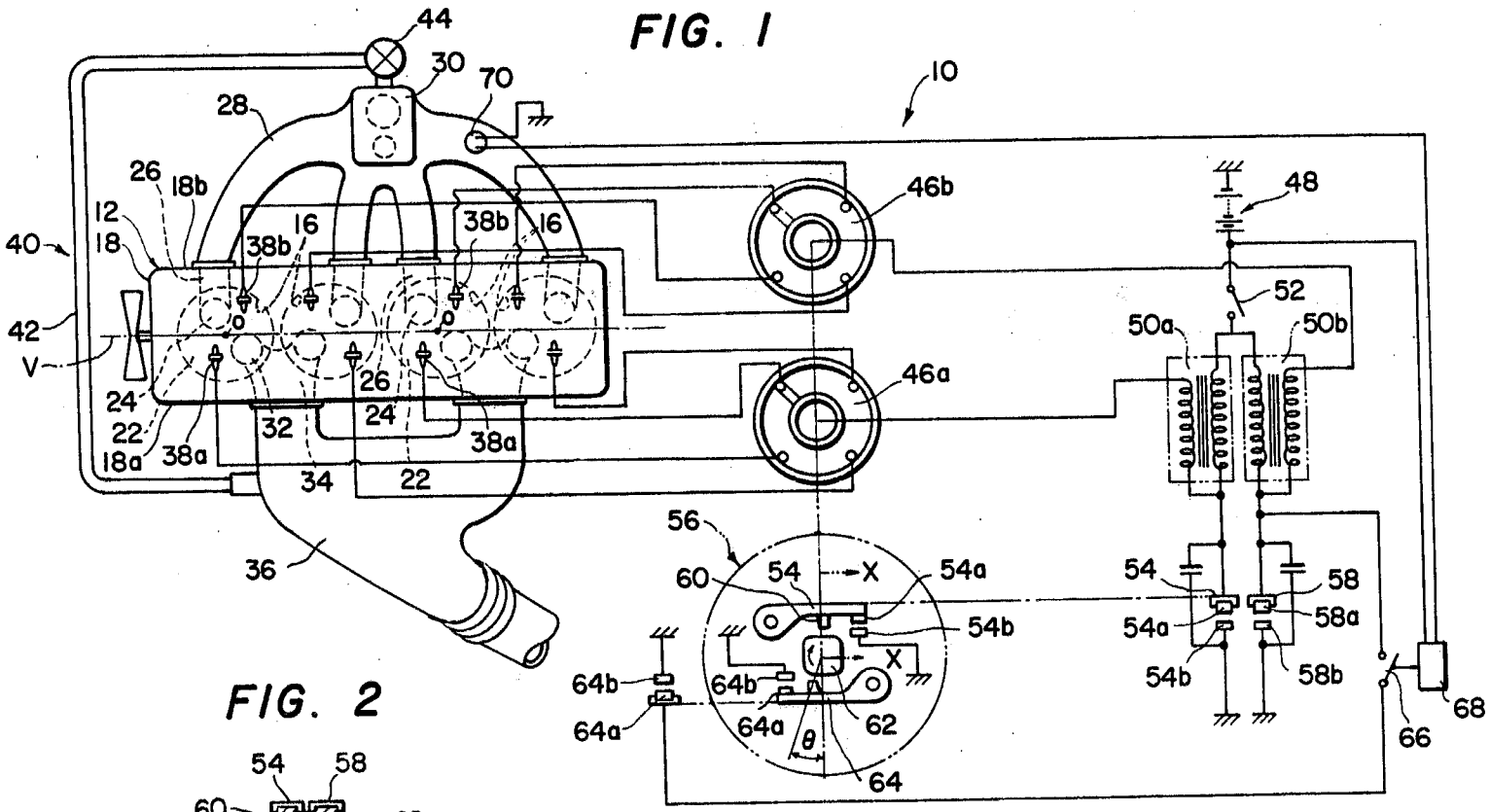
FIG. 1 is a schematic illustration of a preferred embodiment of an internal combustion engine in accordance with the present invention.
Figure 2:
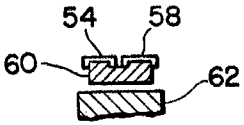
FIG. 2 is a cross-sectional view taken substantially along the line X—X of FIG. 1.
Figure 3:
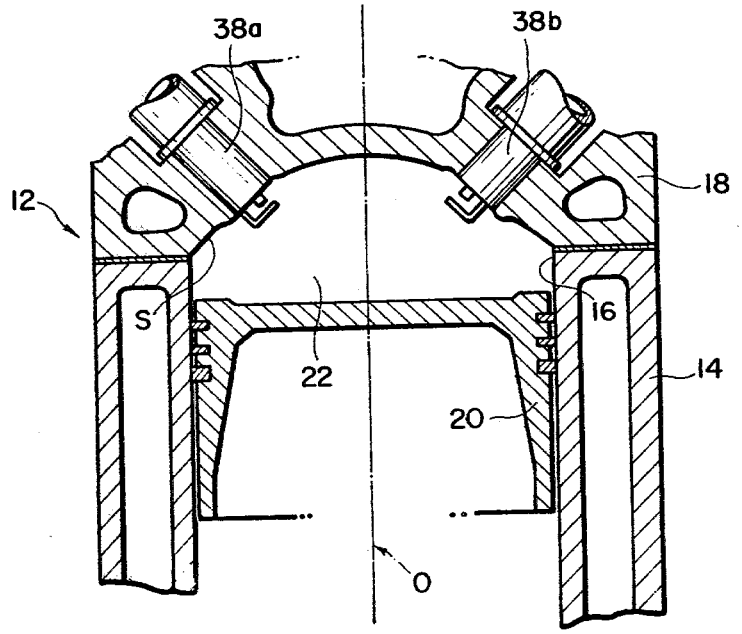
FIG. 3 is a vertical sectional view showing a combustion chamber of the engine of FIG. 1.

Referring now to FIGS. 1, 2 and 3 of the drawings, a preferred embodiment of an internal combustion engine 10 in accordance with the principle of the present invention is shown as including an engine proper 12 thereof. The engine proper 12 is composed of a cylinder block 14 in which four engine cylinders 16 are formed as shown. Secured to the top portion of the cylinder block 14 is a cylinder head 18 which is formed with a concavity of which surface S closes one end of the cylinder 16. A piston 20 is disposed reciprocally movable within the cylinder 16. A combustion chamber 22 is defined by the cylindrical inner wall surface of the cylinder 16, the concave surface S of the cylinder head 18, and the crown of the piston 20.

Each combustion chamber 22 is communicable through an intake valve head 24 with an intake port 26 which, in turn, communicates through an intake manifold 28 or an intake passage with a carburetor 30. The combustion chamber 22 is further communicable through an exhaust valve head 32 with an exhaust port 34. The exhaust port 34 is shared by two adjacent cylinders 16 and accordingly is referred to as a so-called siamesed exhaust port. The exhaust port 34 communicates with an exhaust manifold 36 which serves as a thermal reactor for thermally oxidizing the unburned constituents contained in the exhaust gases discharged from the combustion chamber 22. As seen, the cylinder head 18 of this case employs a cross-flow induction-exhaust arrangement in which the exhaust port 34 opens to one side surface 18*a* thereof and the intake port 26 opens to an opposite side surface 18*b* thereof.

In each combustion chamber 22, a first spark plug 38*a* and a second spark plug 38*b* are disposed to be secured to the cylinder head 18 so that the electrodes (no numerals) thereof project and lie in the combustion chamber 22. The first spark plug 38*a* is located such that its electrodes lie at the same side as the cylinder head side surface 18*a* with respect to an imaginary longitudinal vertical plane V which extends parallel with the longitudinal axis (not shown) of the cylinder head 18 and passes through the center axis O of the cylinder bores as clearly seen from the Figures. On the contrary, the second spark plug 38*b* is located at the same side as the cylinder head side surface 18*b*. Hence, the first and second spark plugs 18*a* and 18*b* are located on opposite sides of the longitudinal vertical plane V.

The reference numeral 40 represents an Exhaust Gas Recirculation (EGR) system or means for recirculating a portion of the exhaust gases back to the combustion chamber 22. The EGR system 40 is composed of a conduit 42 or a passageway which connects the exhaust manifold 36 forming part of an exhaust system (no numeral) and the intake manifold 28 forming part of an intake system (no numeral). Disposed in the conduit 42 is a control valve 44 which is arranged to control the amount of the exhaust gases recirculated from the exhaust system into the combustion chamber with respect to the amount of the intake air inducted through the intake system into the combustion chamber 22 in response, for example, to the venturi vacuum which is a function of the amount of the intake air. In this case, the control valve 44 is arranged to control the exhaust gases recirculated into the combustion chamber within a range up to 50% by volume of the intake air. This volume rate of recirculated exhaust gases is referred to as the "EGR rate". In general, the maximum EGR rate is encountered during acceleration under normal engine operating condition.

Each first spark plug 38*a* is electrically connected to a corresponding terminal of a first distributor 46*a* which functions, as usual, to distribute high tension current supplied thereto to the first spark plugs 38*a* disposed in respective combustion chambers 22. The high tension current is supplied from a first high tension current generating means (no numeral) for generating high tension current by transforming electric current from an electric source such as a battery 48 into the high tension current. The first high tension current generating means is composed of a first ignition coil 50*a* electrically connected to the first distributor 46*a*. The first ignition coil 50*a* includes, as customary, a primary winding (no numeral) electrically connected through an ignition switch 52 to the battery 48, and a secondary winding (no numeral) electrically connected to the first distributor 46*a*.

Similarly, each second spark plug 38*b* is electrically connected to a corresponding terminal of a second distributor 46*b* which is, in turn, electrically connected to a second ignition coil 50*b* forming part of a second high tension current generating means (no numeral) for generating high tension current by transforming electric current from the battery 48 into high tension current.

The second high tension current generating means includes, as customary, a primary winding (no numeral) electrically connected through the ignition switch 52 to the battery 48, and a secondary winding (no numeral) electrically connected to the second distributor 46*b*.

The first and second windings of the first ignition coil 50*a* are electrically connected to a first movable contact point 54*a* secured to a first breaker arm 54 forming part of a contact breaker 56. The first and second windings of the second ignition coil 50*b* are electrically connected to a second movable contact point 58*a* secured to a second breaker arm 58. The first and second breaker arms 54 and 58 are equipped with a common heel portion 60 or a projection which is arranged to fixedly connect the breaker arms 54 and 58 and to be hit by corner portions (no numerals) of a revolving cam 62. Accordingly, the first contact points 54*a* and 54*b* and the second contact points 58*a* and 58*b* simultaneously open or close. With this contact breaker 56, when the contact points 54*a*, 54*b* and 58*a*, 58*b* open, the current in the primary windings of the first and second ignition coils 50*a* and 50*b* is interrupted, so that the electromagnetic fields generated around the primary windings collapse. The collapse of these fields induces in the secondary windings voltages which are much higher than that of the battery. The high tension current having thus induced high voltage is supplied through the first and second distributors 46*a* and 46*b* to the first and second spark plugs 38*a* and 38*b*.

As shown, the contact breaker 56 further includes a third breaker arm 64 which has a third movable contact point 64*a*. The point 64*a* is arranged to be contactable with a stationary contact point 64*b* in accordance with the rotation of the revolving cam 62. The contact points 64*a* and 64*b* are arranged to open and close with a predetermined phase difference of $\theta$ degrees in terms of the rotation angle of the revolving cam 62 (which corresponds to $2\theta$ in terms of crank angle) relative to the opening and respective timings of closing of the contact points 54*a*, 54*b* and 58*a*, 58*b*. The predetermined phase difference is preferably in a range from 10 to 90 degrees, more preferably 10 to 30 degrees, of the crank angle. The third movable contact 64*a* is electrically connected through a normally open relay switch 66 to a line connecting the second ignition coil 50*b* and the second movable contact point 58*a*. The relay switch 66 is arranged to be actuated to be closed, for example, by an actuator 68 having an electromagnetic coil or a solenoid. The electromagnetic coil of the actuator 68 is electrically connected to a vacuum operated switch 70 or detecting means for detecting a high engine power output operating condition where the engine operates at high load and/or high speed. The vacuum operated switch 70 is disposed to receive the intake vacuum in the intake manifold 28 and arranged to produce an electrical signal to energize the electromagnetic coil of the actuator 68 to close the switch 66 when the intake manifold vacuum is lower than a predetermined level, such as a vacuum of 80 mmHg. It will be understood that an intake manifold vacuum lower than the predetermined level represents the high power output engine operating conditions.

Figure 4:
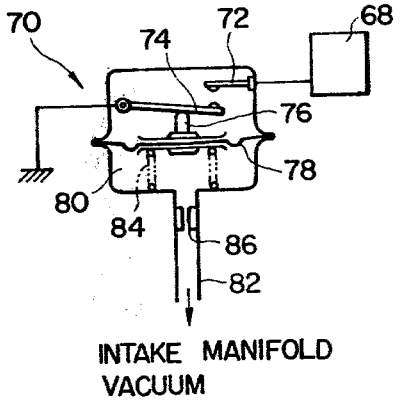
FIG. 4 is a schematic representation of a vacuum operated switch used in the engine of FIG. 1.

FIG. 4 shows in detail the vacuum operated switch 70 which is composed of a stationary contact 72 electrically connected to the electromagnetic coil of the actuator 68 and grounded movable contact 74. The movable contact 74 is arranged to contact the stationary contact 72 when urged in an upward direction in the drawing by a push-rod 76. The push-rod 76 is secured to a diaphragm member 78 which defines a vacuum chamber 80. The vacuum chamber 80 communicates with the inside of the intake manifold 28 through a vacuum passage 82. A spring member 84 is disposed in the vacuum chamber 80 to urge the diaphragm member 78 in the upward direction in the drawing so that the push-rod 76 causes the movable contact 74 to contact the stationary contact 72. With the arrangement of this vacuum operated switch 70, when the intake manifold vacuum falls below the predetermined level or 80 mmHg, the spring member 84 pushes the diaphragm member 78 up against the vacuum transmitted from the intake manifold 28, causing the movable contact 74 to contact the stationary contact 72 so as to close the switch 70. The reference numeral 86 represents a flow restrictor in the form of an orifice, formed in the vacuum passage 82 through which orifice the intake manifold vacuum is supplied to the vacuum chamber 80. Accordingly, it will be appreciated that, by the effect of the flow restrictor 86, the vacuum operated switch 70 is prevented from undesirable closing caused by fluctuation of the diaphragm member 78 due to the pulsation of the intake manifold vacuum, because, the flow restrictor 86 functions to weaken or nullify the pulsation of the intake manifold vacuum.

The operation of the engine 10 according to the present invention illustrated in FIGS. 1, 2, 3 and 4 will now be explained.

Under normal engine operating conditions, the intake manifold vacuum is relatively high, i.e., higher than a vacuum level of 80 mmHg and accordingly the vacuum operated switch 70 is open since the movable contact 74 thereof does not contact the stationary contact 72 thereof. In this state, the relay switch 66 is open to interrupt the electrical connection between the second ignition coil **50*b* and the third movable contact point 64*a* secured to the third breaker arm 64 of the contact breaker 56. Consequently, the high tension current generated by the secondary windings of the first and second ignition coils 50*a* and 50*b* is substantially simultaneously supplied to the each first spark plug 38*a* and each second spark plug 38*b*. Therefore, each first spark plug 38*a* and each second spark plug 38*b* are substantially simultaneously energized to produce sparks to ignite the charge present in each combustion chamber 22. This dual spark plug ignition allows stable combustion in the combustion chamber 22 even when a considerably large amount of the exhaust gases is recirculated back to the combustion chamber 22**. Accordingly, a remarkable reduction of NOx emission level is attained without causing degradation of engine driveability.

On the contrary, under a high power output or a high load engine operating condition, the intake manifold vacuum is relatively low, for example lower than a vacuum level of 80 mmHg, and accordingly the vacuum operated switch 70 is closed since the movable contact 74 is allowed to contact the stationary contact 72. Then, the electromagnetic coil of the actuator 68 is energized to allow the relay switch 66 to close, establishing the electrical connection between the second ignition coil **50*b* and the third movable contact point 64*a* secured to the third breaker arm 64 of the contact breaker 56. In this state, although the first and second contact points 54*a*, 54*b* and 58*a* and 58*b* are opened, high voltage is generated only at the second winding of the first ignition coil 50*a*, and accordingly the high tension current having the thus generated high voltage is supplied only to the first spark plugs 38*a*. High voltage is not generated at the secondary winding of the second ignition coil 50*b* only by the opening of the contact points 58*a*, 58*b*, and accordingly high tension current is not supplied to the second spark plug 38*b* even if the first spark plugs 38*a* are supplied with the high tension current. The current in the primary winding of the second ignition coil 50*b* is interrupted to generate the high voltage for the first time after the second contact points 58*a* and, 58*b* are opened and when the third contact points 64*a* and 64*b* are opened. Consequently, the spark timing of the second spark plug 38*b* is retarded by the above-mentioned $2\theta$ degrees of the crank angle relative to that of the first spark plug 38*a*, and therefore the second spark plug 38*b* is energized to produce spark later than the first spark plug 38*a* by $2\theta$ degrees of the crank angle. Thus, the charge in each combustion chamber 22 is ignited with only the first spark plug 38*a*** under the high power engine operating condition. In other words, the dual spark plug ignition under the normal engine operating condition is converted into a substantially single spark plug ignition under the high power engine operating condition. This ignition manner with only one spark plug prolongs the combustion time of the charge to suppress the excessive pressure rise in the combustion chamber. This can prevent generation of unusual engine vibration and increased engine noise due to high frequency sound which is liable to be induced with the dual spark plug ignition under the high power output engine operating condition.

Furthermore, since the second spark plug **38*b* which does not substantially contribute to the ignition of the charge is also energized to produce spark, carbon deposits and engine oil do not accumulate on the surface of the second spark plug 38*b*, and if they adhere to the surface of the plug 38*b*, the spark produced by the plug 38*b* burns them off. Hence, the second spark plug 38*b* is maintained at a suitable temperature, preventing thermal damage of the second spark plug 38*b*** itself and excessive pre-ignition which is liable to be caused by excessive heating of the second spark plug due to the adherence of the carbon deposits and the engine oil. As a result, stable ignition and combustion of the charge are always attained.

Additionally, by the action of the spark produced at the second spark plug **38*b***, the combustion time of the charge is not so prolonged though the dual spark plug ignition is changed into a substantially single spark plug ignition. Therefore, engine power output characteristics are prevented from being discontinuously changed.

While only an ignition system equipped with the contact points has been shown and described, it will be understood that the ignition system may be replaced with one which uses transistors and is equipped with a switching device having no contact points.

Figure 5:
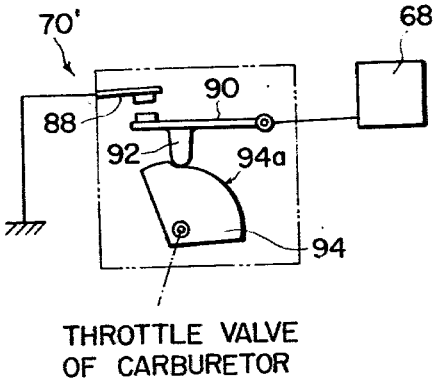
FIG. 5 is a schematic representation of a throttle operated switch used in the engine of FIG. 1.

FIG. 5 shows a throttle operated switch 70' used as the detecting means for detecting the high power output engine operating condition and accordingly the switch 70' is replaceable with the above-mentioned vacuum operated switch 70. This throttle operated switch 70' is composed of a grounded stationary contact 88 and a movable contact 90 which is electrically connectable to the electromagnetic coil of the actuator 68. The movable contact 90 is provided with a projection 92 which slidably contacts the contoured cam surface 94a of a cam 94. Consequently, the projection 92 serves as a cam follower. The cam 94 is operatively connected to the throttle shaft on which a throttle valve (not shown) of the carburetor 30 is fixed and therefore the cam 94 rotates with the throttle shaft of the carburetor 30. The throttle valve may be that used in an engine equipped with a fuel injection system in which the carburetor is not used. The contoured cam surface 94a is arranged to push the projection 92 to cause the movable contact 90 to contact the stationary contact 88 in order to energize the electromagnetic coil of the actuator 68 when the opening degree of the carburetor throttle valve becomes larger than a predetermined angle of, for example, 40 degrees. It will be understood that the throttle valve opening degree larger than 40 degrees represents the high power output engine operating conditions.

While only the vacuum operated switch 70 and the throttle operated switch 70' have been shown and described as examples of the detecting means, it will be understood that the switch 70 or 70' may be replaced with an acceleration sensing switch for actuating the relay switch 66 in response to the acceleration of the engine, or with a venturi vacuum sensing switch for actuating the relay switch 66 in response to venturi vacuum generated in the venturi portion of the carburetor 30. Furthermore, the high power output engine operating condition may be detected by an engine speed sensing switch for actuating the relay switch 66 in response to the engine speeds, or by a vehicle speed sensing switch for actuating the relay switch 66 in response to vehicle cruising speeds. It will be understood that some of the above-mentioned various sensing switches may used in combination to detect the high power output engine operating condition.

What is claimed is:

1. An internal combustion engine having a combustion chamber, comprising:

first and second spark plugs disposed in the combustion chamber;

means for recirculating a portion of exhaust gases back to the combustion chamber;

first high tension current generating means for generating high tension current to energize said first spark plug to cause said first spark plug to produce spark when operated;

second high tension current generating means for generating high tension current to energize said second spark plug to cause said second spark plug to produce spark when operated;

means for simultaneously operating said first and second high tension current generating means to simultaneously energize said first and second spark plugs under normal engine operating condition;

means for detecting a high power output engine operating condition and for generating a signal indicating said operating condition; and switching means, responsive to said signal, for operating said second high tension current generating means with a predetermined phase difference relative to the operation of said first high tension current generating means under said high power output engine operating conditions.

2. An internal combustion engine as claimed in claim 1, in which said first high tension current generating means includes a first ignition coil electrically connected to said first spark plug, and first contact points openable by the action of a revolving cam and electrically connected to said first ignition coil;

said second high tension current generating means includes a second ignition coil electrically connected to said second spark plug, and second contact points which are openable by the action of the revolving cam and electrically connected to said second ignition coil; and the simultaneous operating means includes means for causing the first and second contact points to simultaneously open.

3. An internal combustion engine as claimed in claim 2, in which said detecting means comprises a vacuum operated switch disposed to receive an intake vacuum in an intake passage connected to an intake port, connected to supply a switching signal to solenoid-operated relay switch in response to an intake vacuum lower than a pre-determined level representing a high power output engine operating condition.

4. An internal combustion engine as claimed in claim 3, in which said vacuum operated switch includes a stationary contact electrically connected to the electromagnetic coil of said solenoid operated relay switch, a grounded movable contact contactable to said stationary contact, a diaphragm member defining a vacuum chamber which communicates with said intake passage, a push-rod secured to said diaphragm member to be contactable with said movable contact, and a spring member disposed in said vacuum chamber to urge said diaphragm member so that said push-rod causes said movable contact to contact said stationary contact when said intake vacuum is lower than said predetermined level.

5. An internal combustion engine as claimed in claim 4, in which said vacuum operated switch includes a vacuum passage connecting said vacuum chamber and said intake passage, and a flow-restrictor formed in said vacuum passage.

6. An internal combustion engine as claimed in claim 2, in which said detecting means comprises a throttle operated switch arranged to supply said signal to a solenoid operated relay switch when the opening degree of the throttle valve exceeds a predetermined level representing a high power output engine operating condition.

7. An internal combustion engine as claimed in claim 6, in which said throttle operated switch includes a grounded stationary contact, a movable contact electrically connected to the electromagnetic coil of said solenoid operated relay switch and contactable to said stationary contact, a projection secured to said movable contact, said projection serving as a cam follower, and a cam operatively connected to a throttle shaft on which the throttle valve is fixedly mounted, and rotatable with said throttle shaft, said cam being formed with a contoured cam surface along which said projection slidably moves, said contoured cam surface being arranged to force said movable contact to contact, through said projection, the stationary contact when the opening degree of the throttle valve is larger than said predetermined level.

8. An internal combustion engine having a combustion chamber, comprising:

first and second spark plugs disposed in the combustion chamber;

means for recirculating a portion of exhaust gases back to the combustion chamber;

first high tension current generating means for generating high tension current to energize said first spark plug to cause said first spark plug to produce spark when operated, said first high tension current generating means including a first ignition coil electrically connected to said first spark plug, a revolving cam, and first contact points openable by the action of said revolving cam and electrically connected to said first ignition coil;

second high tension current generating means for generating high tension current to energize said second spark plug to cause said second spark plug to produce spark when operated, said second high tension current generating means including a second ignition coil electrically connected to said second spark plug, and second contact points which are openable by the action of said revolving cam and electrically connected to said second ignition coil;

means for simultaneously operating said first and second high tension current generating means to simultaneously energize said first and second spark plugs under normal engine operating conditions, said simultaneous operating means including means for causing the first and second contact points to simultaneously open;

means for detecting a high power output engine operating condition and for generating a signal indicating said operating conditions; and switching means, responsive to said signal, for operating said second high tension current generating means with a pre-determined phase difference relative to the operation of said first high tension current generating means under said high power output engine operating conditions, said switching means including third contact points openable by the action of said revolving cam and electrically connected to a line connecting said second contact points and said second ignition coil, said third contact points being opened with the pre-determined phase difference relative to the opening timing of said first and second contact points, and a solenoid-operated relay switch disposed between said line and said third contact points, said relay switch being arranged to be closed to establish the electrical connection between said line and said third contact points when energized, said relay switch being arranged to be energized on receiving said signal for said detecting means.

9. An internal combustion engine as claimed in claim 8, in which said phase difference is in the range from 10 to 90 degrees in terms of crank angle.

* * * * *